US006746306B2

(12) United States Patent
Brothers

(10) Patent No.: US 6,746,306 B2
(45) Date of Patent: Jun. 8, 2004

(54) POSTOPERATIVE BILATERAL AUGMENTATION MAMMAPLASTY BRASSIERE

(76) Inventor: David B. Brothers, 4690 Chardonnay Ct., Dunwoody, GA (US) 30338

( * ) Notice: Subject to any disclaimer, the term of this patent is extended or adjusted under 35 U.S.C. 154(b) by 0 days.

(21) Appl. No.: 10/099,148

(22) Filed: Mar. 15, 2002

(65) Prior Publication Data

US 2002/0177385 A1 Nov. 28, 2002

Related U.S. Application Data

(60) Provisional application No. 60/276,726, filed on Mar. 16, 2001.

(51) Int. Cl.[7] ..... A41C 3/00

(52) U.S. Cl. ..... 450/41; 450/47; 450/45

(58) Field of Search ..... 450/41, 45, 46, 450/47, 49, 51, 52; 2/255–259, 262, 264; 623/7, 8

(56) References Cited

U.S. PATENT DOCUMENTS

| | | | | | |
|---|---|---|---|---|---|
| 2,463,319 | A | * | 3/1949 | Schwartz | 450/41 |
| 2,480,049 | A | * | 8/1949 | Rosenberg | 450/41 |
| 2,622,244 | A | | 12/1952 | Alberts | 2/42 |
| 2,769,180 | A | | 11/1956 | Tareau et al. | 2/264 |
| 2,829,650 | A | * | 4/1958 | Guide | 450/41 |
| 3,747,606 | A | | 7/1973 | Tareau | 128/472 |
| 3,750,673 | A | | 8/1973 | Penrock | 128/564 |
| 5,401,203 | A | | 3/1995 | Fildan | 450/41 |
| 5,527,202 | A | | 6/1996 | Morgan et al. | 450/48 |
| 5,730,641 | A | * | 3/1998 | Brown | 450/41 |
| 5,820,444 | A | | 10/1998 | McGaughey | 450/70 |
| 5,830,040 | A | | 11/1998 | Morgan et al. | 450/41 |
| 5,934,970 | A | | 8/1999 | Morgan et al. | 450/41 |
| 6,019,662 | A | | 2/2000 | Fildan | 450/41 |
| 6,066,027 | A | | 5/2000 | Fildan | 450/52 |
| 6,106,363 | A | | 8/2000 | Werner | 450/41 |
| 6,190,232 | B1 | | 2/2001 | Boser | 450/47 |
| 6,203,400 | B1 | | 3/2001 | Allen et al. | 450/41 |
| 6,206,753 | B1 | | 3/2001 | Werner | 450/41 |

FOREIGN PATENT DOCUMENTS

| | | |
|---|---|---|
| FR | 1.085.245 | 1/1955 |

* cited by examiner

*Primary Examiner*—Gloria M. Hale
(74) *Attorney, Agent, or Firm*—Needle & Rosenberg, PC.

(57) ABSTRACT

A postoperative bilateral augmentation mammaplasty brassiere for use by women with augmented breasts is disclosed. The brassiere provides a support cup shaped to mimic a spherically shaped breast implant. The brassiere further provides an underwire within the construction of the brassiere, the underwire having a semicircular portion to mimic the round base of an augmented breast. A connector is provided between two support cups, each with an associated underwire, such that the distance between proximal ends of the underwires is established for the comfort of the wearer and the attractive appearance of the brassiere.

35 Claims, 6 Drawing Sheets

POSTOPERATIVE BILATERAL AUGMENTATION MAMMAPLASTY BRASSIERE

CROSS-REFERENCE TO A RELATED APPLICATION

This application claims priority to provisional U.S. patent application Ser. No. 60/276,726, filed Mar. 16, 2001 in the United States Patent and Trademark Office, and entitled "Postoperative Bilateral Augmentation Mammaplasty Brassiere."

FIELD OF THE INVENTION

The invention relates in general to brassieres. More particularly, the invention relates to a brassiere adapted for the needs of a woman who has undergone a bilateral augmentation mammaplasty or breast augmentation procedure.

BACKGROUND OF THE INVENTION

During a breast augmentation procedure, many of the supportive ligaments of the breast, as well as the natural inframammary crease, are disrupted and weakened. Despite capsule or natural scar formation around the breast implant, the weight of the implant coupled with the stretching and loss of elasticity of the skin can lead to an unaesthetic lowering of the implant that may require additional corrective surgery. Additionally, breast implants typically alter the natural breast size and shape. Currently, breast augmentation patients are instructed to wear a supportive brassiere after surgery, but none of the brassiere designers, manufacturers, and/or vendors has developed a brassiere to meet the unique needs for this population of women.

The natural shape of a woman's breasts prior to a bilateral augmentation mammaplasty has a "teardrop" profile with a gentle concave downslope extending from below the clavicle to the nipple. The shape of the inframammary (under the breast) fold of the natural breast has the shape of a flattened semicircle. This flattened semicircular fold is representative of the shape of the similarly shaped underwires used in constructing the known types of brassieres.

The shapes of the cups of conventional brassieres are typically conical. A conically shaped brassiere cup does not comfortably accommodate the hemispherical shape of the augmented breast formed by the underlying breast implant. Conically shaped cups typically are tight around the base of the augmented breast, and the rounded bust point of the augmented breast does not fill out the "tip" of the cone leaving excess unattractive fabric in this area, nor is the bust point supported. Although conventional brassiere construction works well for the majority of women who have not augmented their breasts, the known types of brassieres do not provide for the augmented breast shape and related chest wall relationships or the additional support required by a woman with augmented breasts.

The typical augmented breast has a somewhat hemispherical shape, and a convex downslope extending from below the clavicle to the nipple. Additionally, the augmented breast has a relatively smaller base diameter on the chest wall when compared to a natural breast of equal volume. This is the reason many women with augmented breasts have a wide cleavage or medial distance between the breasts. Additionally, the inframammary folds have been lowered. The bust point, or nipple, also has a greater anterior projection than that of a natural breast, and the inframammary fold is now a true semicircle in accordance with the circular shape of the round breast implant.

Current brassieres provide poor support and fit for the woman who has undergone a breast augmentation. For example, after a breast augmentation, a women that is properly measured and should be wearing a 32D brassiere typically cannot find a properly fitting brassiere because this breast size is not a common natural breast size. Such a women is forced to wear a size 34C brassiere due to the adequately sized, although not optimally shaped, underwire provided thereby. However, the brassiere band is too large and breast support is transferred to the shoulder straps resulting in discomfort to the wearer over time. Further, the cups of available brassieres, which are not shaped for augmented breasts, fail to provide appropriate fit to augmented breasts which leads to discomfort and inadequate support.

In conventionally constructed brassieres, the center front connector between the cups also is not wide enough for proper fit on a woman with augmented breasts. The connector typically bowstrings between the augmented breasts and is raised off of the chest wall thus diminishing the brassiere's cantilevered support system. The brassiere cups and breasts are thus forced medially toward center front. Consequently, the cups and underwires are distorted, the cleavage is deepened and the brassiere appears unattractive and too tight. There should be no space between the center front section and the chest wall in a properly fitted, comfortable and attractive brassiere that offers the full benefit of a cantilevered support system. What is needed is a center front connector that eliminates the above-mentioned problems and ensures proper fit, comfort and support for the breasts.

The currently available brassieres do not, therefore, address the specific structural and anatomic needs unique to the growing population of women with breast implants. There is no brassiere that is specifically designed for the shape, size, and relative placement of augmented breasts. The need has thus arisen for a uniquely designed, supportive, and attractive post surgical brassiere for women who have undergone breast augmentation.

SUMMARY OF THE INVENTION

The present invention is a postoperative bilateral augmentation mammaplasty brassiere that is specifically designed for women with surgically augmented breasts, having either saline-filled or silicone gel-filled breast implants positioned above or below the pectoralis major muscle. The brassiere of the present invention offers these women customized fit and maximum support in an attractive, fashionable brassiere.

In combination with the known elements of brassiere construction, at least three unique design features are present in the brassiere of this invention. First is the shape of the underwire, formed as a slightly lengthened true semicircle with slight center front outward deflection and lateral outward deflection. Second, is the shape of the brassiere cup in that it has an arcuate shape in both the vertical and horizontal directions for creating a "spherical" cup. The arc of the sphere is a mathematically defined segment of a circle which compliments the shape of the breast implant and, therefore, the augmented breast. Third, the defined width of the center front connector and its relationship to the center front tips of the underwires of the brassiere allow for better fit, comfort, appearance and support.

It is anticipated that each individual manufacturer's design model for the brassiere will be a young to middleaged woman of average height and ideal body weight with varying breast band sizes with an augmented breast of various sizes. For design purposes, the pre-augmentation breast size of these women ideally should not be larger than a small B cup so that the post-augmented breast most closely mimics the shape and volume of the underlying breast implant. The present invention will allow for the lowered and semicircular inframammary crease that occurs after a breast augmentation, the widened cleavage that occurs, and will allow for larger and more projected, spherical cup sizes thus maintaining comfort and adequate brassiere band support.

Accordingly, in a first embodiment, a brassiere for use by a woman that has undergone a mammaplasty or breast augmentation procedure is disclosed, the brassiere comprising a first support cup and a first elongate underwire formed as a part of the cup, where the underwire defines at least in part a first semi-circular arc. The first underwire comprises an elongate first semi-circular arc segment with a first elongate extension extending away therefrom and outwardly of a first end of the arc segment. The underwire may further comprise a second elongate extension which extends away from and outwardly of a second end of the arc segment.

The brassiere includes a second support cup having a second underwire formed as a part thereof, the second underwire defining at least in part a second semi-circular arc. Both the first and second underwires are spaced from and with respect to one another by a connector attaching the first support cup to the second support cup. The connector is sized and shaped so that the first ends of the respective underwires are spaced from one another by a distance of approximately 2.5 cm. The first arc segment and the second arc segment, respectively, each subtend an angle of approximately 140 degrees.

In a second aspect, the brassiere comprises a first support cup sized and shaped to have a hemispherical shape, and has a first underwire formed as a part of the first support cup. The first underwire is once again formed to have a first semi-circular arc segment, with a first extension at a first end of the arc segment which extends away from and outwardly of the arc segment. The first underwire also has a second extension at a second end of the first arc segment, the second extension also extending away from and outwardly of said arc segment.

The brassiere further comprises a second support cup sized and shaped to have a spherical shape, with a second underwire formed as a part of the second support cup, and includes a connector extending between and attaching the first support cup to the second support cup. The second underwire comprises a second semi-circular arc segment with first extension and second extension at the respective ends thereof, each such extension extending away from and outwardly of the second arc segment.

The connector extends between the first support cup and the second support cup, and is constructed and arranged to space an end of the first underwire from an end of the second underwire by a distance of approximately 2.5 cm. Both the first and second arc segment subtend an angle of approximately 140 degrees.

In a third aspect of the invention, a method of forming a brassiere is disclosed, the method comprising the steps of forming a first support cup in the shape of a section of a sphere, and forming a first underwire as a part of the first support cup. The step of forming the first underwire includes the steps of forming a first semi-circular arc segment therein and forming a first extension at a first end of the arc segment. The method further comprises forming a second support cup in the shape of a section of a sphere, forming a second underwire as a part of the second support cup, and connecting the first support cup to the second support cup with a connector extending therebetween. The method also includes forming a first semi-circular arc segment in the first underwire, forming a first extension at a first end of the first arc segment, forming a second semi-circular arc segment in the second underwire, and forming a first extension at a first end of the second arc segment.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a" can mean one or more, depending upon the context in which it is used. The preferred embodiment is now described with reference to the Figures, in which like numbers indicate like parts throughout the Figures.

The industry standard for determining the underbust or brassiere band size and cup size will be maintained in the current invention. This is done so that standard commercial brassiere sizing will apply to the brassiere of this invention. The brassiere size therefore has two components, the underbust or band size, for example 32 or 34, and the cup size, for example B or C.

Figure 1:
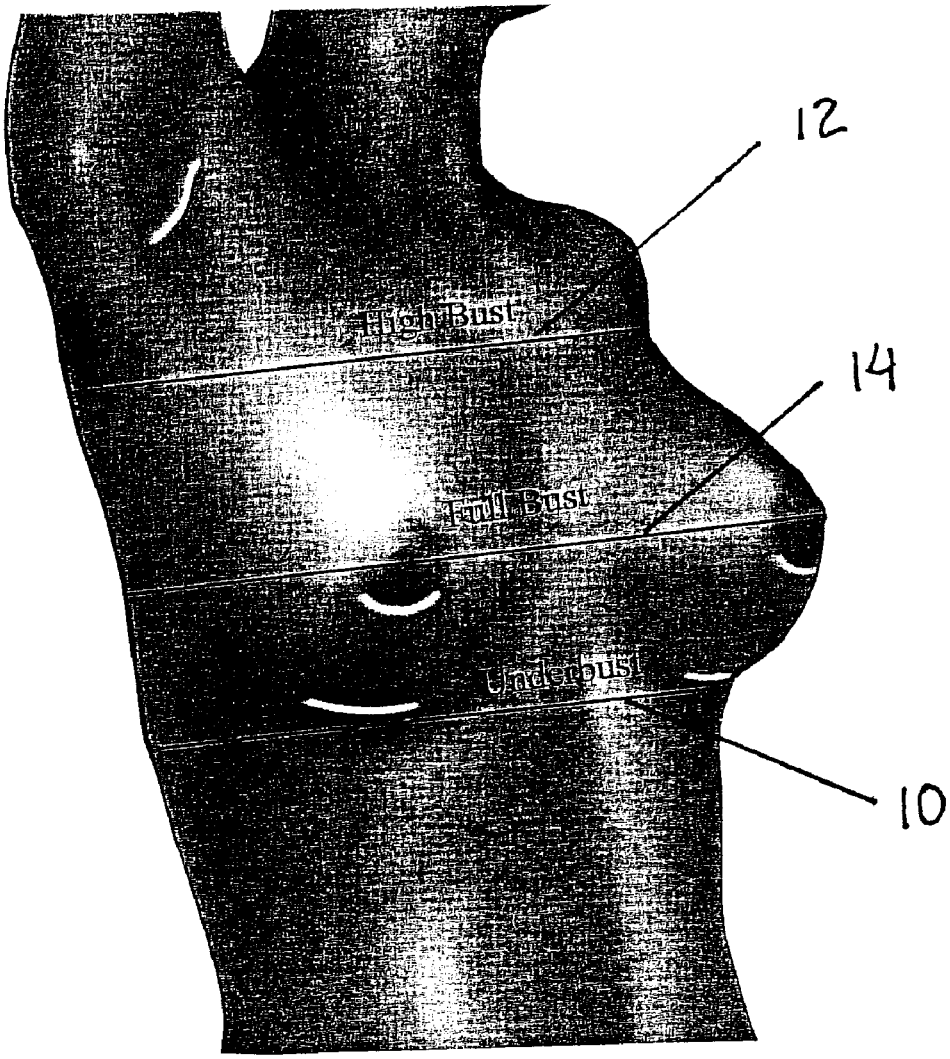
FIG. 1 is a schematic illustration of a woman with augmented breasts.

As is known, the band size and cup size of a properly fitted brassiere are determined conventionally from the results of three horizontal circumference measurements using a tape measure placed around the torso at positions as illustrated in FIG. 1. The underbust 10 is measured around the ribcage just under the folds of the breasts. The high bust 12 is measured around the chest wall above the breasts but below the axillae or armpits. The full bust 14 is measured around the fullest or most projected part of the breasts, typically at the nipples, with the arms at the sides. These measurements should each be made at full expiration with the woman standing upright and the tape for each should be snug but not tight. These measurements are conventionally made in inches in the United States, but other unit systems may be used within the scope of the invention.

The band size of a well-fitted brassiere is determined conventionally by first adding 4 or 5 inches to the underbust measurement to result in an even number of whole inches, and then rounding to the nearest band size. The addition of 4 inches is appropriate for underbust measurements in inches with even whole numbers, and the addition of 5 inches is appropriate for underbust measurements with odd whole numbers. For example, if a woman's underbust measures 30 ½ inches, 4 inches would be first added to result in 34 ½ inches. This result would be rounded down to determine an appropriate 34 band size. Table 1 lists several ranges of underbust measurements and the appropriate conventional band sizes. The band size typically does not change due to a breast augmentation.

TABLE 1

| Underbust Measurement (Inches) | Band Size |
|---|---|
| 27–28½ | 32 |
| 29–30½ | 34 |
| 31–32½ | 36 |
| 33–34½ | 38 |
| 35–36½ | 40 |

The cup size of a well fitted brassiere is conventionally determined from the difference between the high bust 12 and the full bust 14. The high bust measurement is subtracted from the full bust measurement. A difference of 1 inch indicates an A cup as appropriate. A difference of 2 inches indicates a B cup as appropriate. Other cup sizes are similarly determined as listed in Table 2.

TABLE 2

| Difference Between Full Bust and High Bust in Inches. | Cup Size |
|---|---|
| Less Than the High Bust | AAA |
| Same as the High Bust | AA |
| Up to 1" | A |
| Up to 2" | B |
| Up to 3" | C |
| Up to 4" | D |
| Up to 5" | DD or E |

Figure 2:
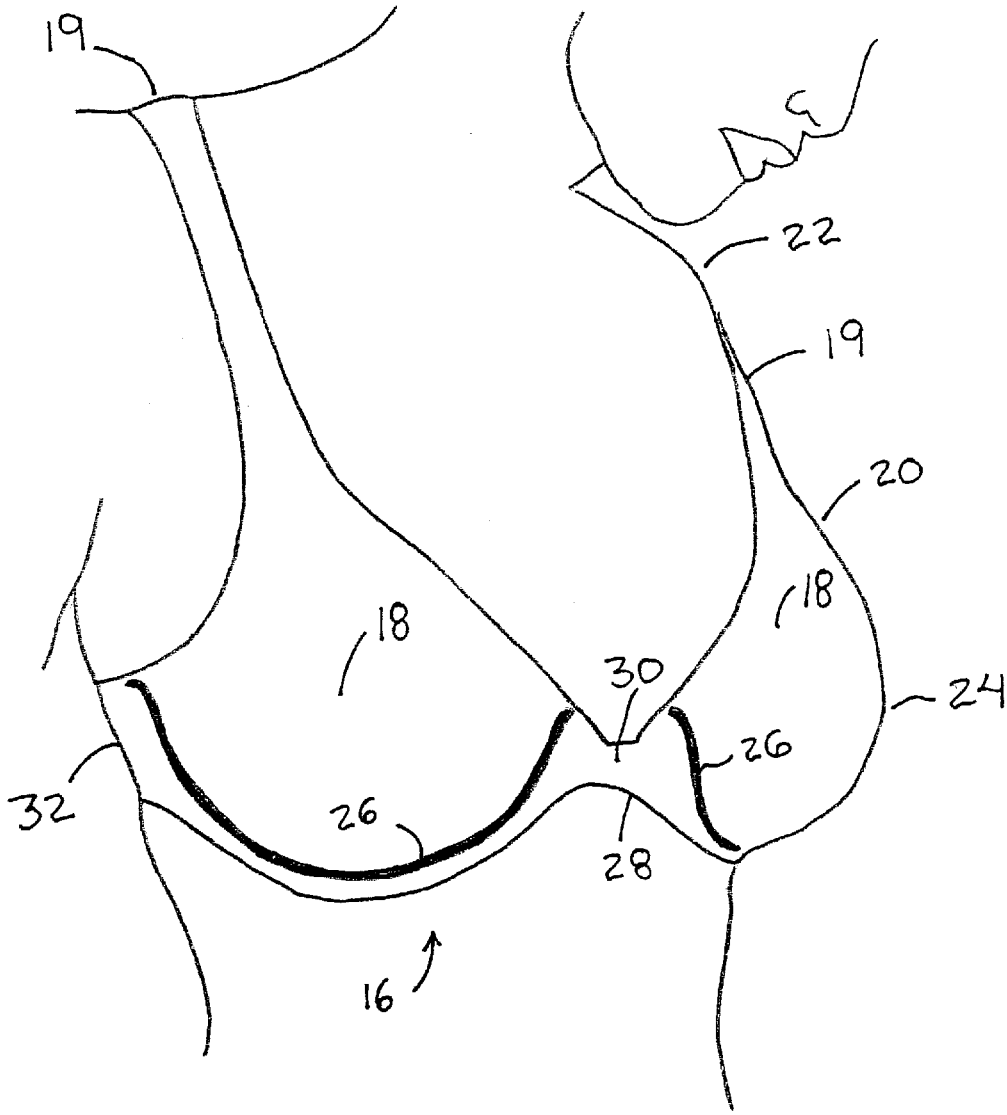
FIG. 2 is a perspective view of a preferred embodiment of the brassiere of the invention.

According to a preferred embodiment of the present invention as illustrated in FIG. 2, the postoperative bilateral augmentation mammaplasty brassiere 16 is provided with cups 18, to support and comfort augmented breasts, and shoulder straps 19 attached thereto. The shape of an augmented breast mimics the round shape of the breast implant with a hemispherical shape, and a convex downslope 20 extending from below the clavicle 22 to the nipple 24. A pair of supportive underwires 26 are provided within the construction of the inventive brassiere 16. The underwires 26 can be disposed within the fabric that forms the brassiere as is known and conventional in brassiere construction. The underwires may each also be enclosed in a soft channeling or casing. The ends of the wires may be coated or have blunt end pieces applied thereto, as desired, in order to prevent puncture of the fabric or casing surrounding the wire.

Figure 3:
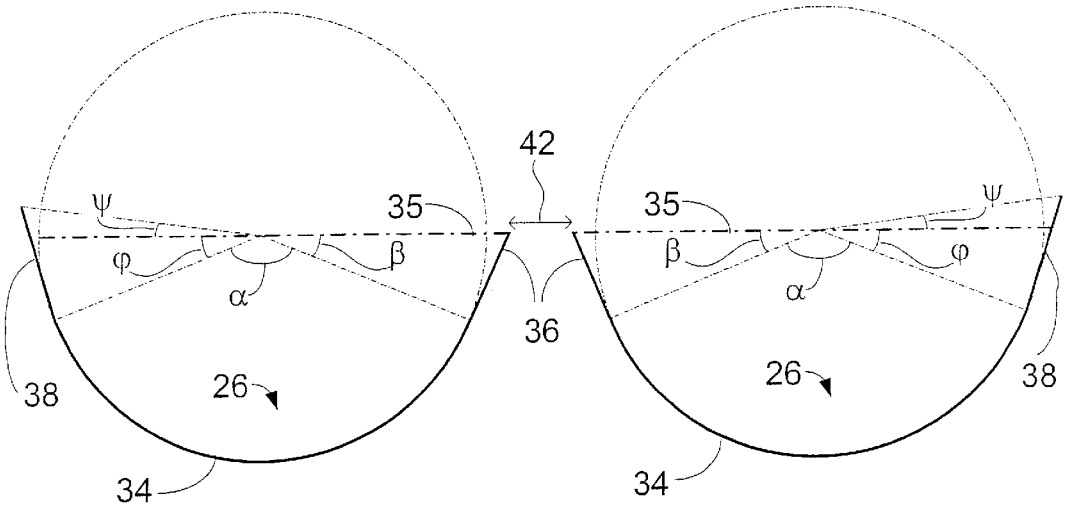
FIG. 3 is a schematic front elevational view of the underwire configuration of the invention.

The cantilevered support for the breasts will be provided by the unique design of the cups 18 coupled with the semicircular shape of the underwires 26, the underbust band 28, the center front connector 30 and the brassiere band 32. As illustrated in FIG. 3, each underwire 26 of the brassiere of this invention is formed with a true semicircle portion 34, an outward center extension 36 at the wire ends proximal the front center of the brassiere, and an outward lateral extension 38 at the wire ends distal the front center of the brassiere. The outward extensions prevent focused pressure points within the brassiere and on the wearer, and makes the brassiere more aesthetic by camouflaging the narrower relative base of the breast and visually reducing the obligatory increased width of the center front connector. The semicircular portion 34 of the underwire mimics the truly circular shape of a breast implant and provides an appropriate fit to the anatomic shape of an augmented breast.

The inventive brassiere constructed as shown in FIG. 2 provides that support for the breasts will be diverted away from the shoulder straps 19 thus minimizing the likelihood of shoulder pain and skin indentations. This is due to the fact that the cups, the brassiere band, the underbust band, the center front connector and the underwires are structurally and circumferentially contiguous and take into consideration the often lowered inframammary fold that occurs after a breast augmentation as well as accommodating the larger, rounder base of the augmented breast.

The cup of this invention may be a demi-cup, an angled demi-cup or a molded cup, as desired. The fabric of the brassiere or cups can have oblique or vertical seaming, or no seaming. As known, an angled cup can push the breast toward the center front, thus enhancing the cleavage and reducing the side fullness of the breasts. The cup design of this invention may be enhanced by permanent or removable angled, thin push-up pads sewn to the side seams of the cups and offering additional non-stretch, cradling support and a slight augmentation effect, while gently angling the breast toward center front and accentuating the cleavage thereof. The cup pads can thus offer additional support to the outer quadrants of the breast.

The brassiere band can be designed in three sections, to include each respective side of the brassiere in association with a cup, and the center front connector. The brassiere band may have a center back closure or a front closure as desired. The frame of the brassiere is preferably fabricated of a washable medium or lightweight fabric. As shown in FIG. 2, the brassiere band 32 is contiguous with or continues under the cups as an underbust band 28 for additional cup support.

A center back two hook closure (not illustrated) with three eyes as is known and conventional in the construction of brassieres, can be used. From the underbust band the brassiere band will gently slope upward toward center back to keep the center back level aesthetic while allowing for the surgically lowered inframammary folds of the augmented breasts. This will also reduce the band width and provide the visual impression of larger breasts. The elasticity of the brassiere band will be also be used to provide additional support for the breasts.

The shoulder straps will be made of a non-stretch material for maximum support, and will be widely placed for better weight distribution. The shoulder straps 19 can be placed in line with the bust point, as illustrated in FIG. 2. The top edge of the cup can be provided with an edging or lacing that can continue onto the shoulder straps to support the inner quadrants of the breast. The edging or lacing would end just below the clavicle so as not to interfere with the bend of the strap material over the shoulder. Each shoulder strap can be positioned to overlie the acromioclavicular groove, and the strap can be slightly wider at the shoulder for better comfort and weight distribution. The shoulder straps may be stitched close to the cup side seam to better distribute weight, and the straps will be adjustable using closed sliders in the back or front for easy access and comfort.

The underwires and their relative positioning within the brassiere are illustrated schematically in FIG. 3. The bottom center of each underwire comprises a semicircular portion 34 which subtends an angle á (alpha) through approximately 140 degrees of a circular arc below a horizontal line 35. A center extension 36 of each underwire joins the semicircular portion 34 at an angle â (beta), approximately 20 degrees, below the horizontal line. The center extension extends away from the arc of the semicircular portion 34 and may extend to the horizontal line as illustrated, or may extend slightly above or below the horizontal line. A lateral extension 38 of each underwire, opposite the center extension, joins the semicircular portion 34 at an angle ○ (phi), approximately 20 degrees, below the horizontal. The lateral extension extends away from the arc of the semicircular portion and terminates at an angle Ø (psi), approximately 10 degrees, above the horizontal. Each center and lateral extension may be formed as a line segment tangent to the circular arc as illustrated in FIG. 3, or as illustrated in FIG. 2 may be formed as an arcuate curve that tapers away from the center of the semicircular portion and extends away from center of the underwire.

Figure 4:
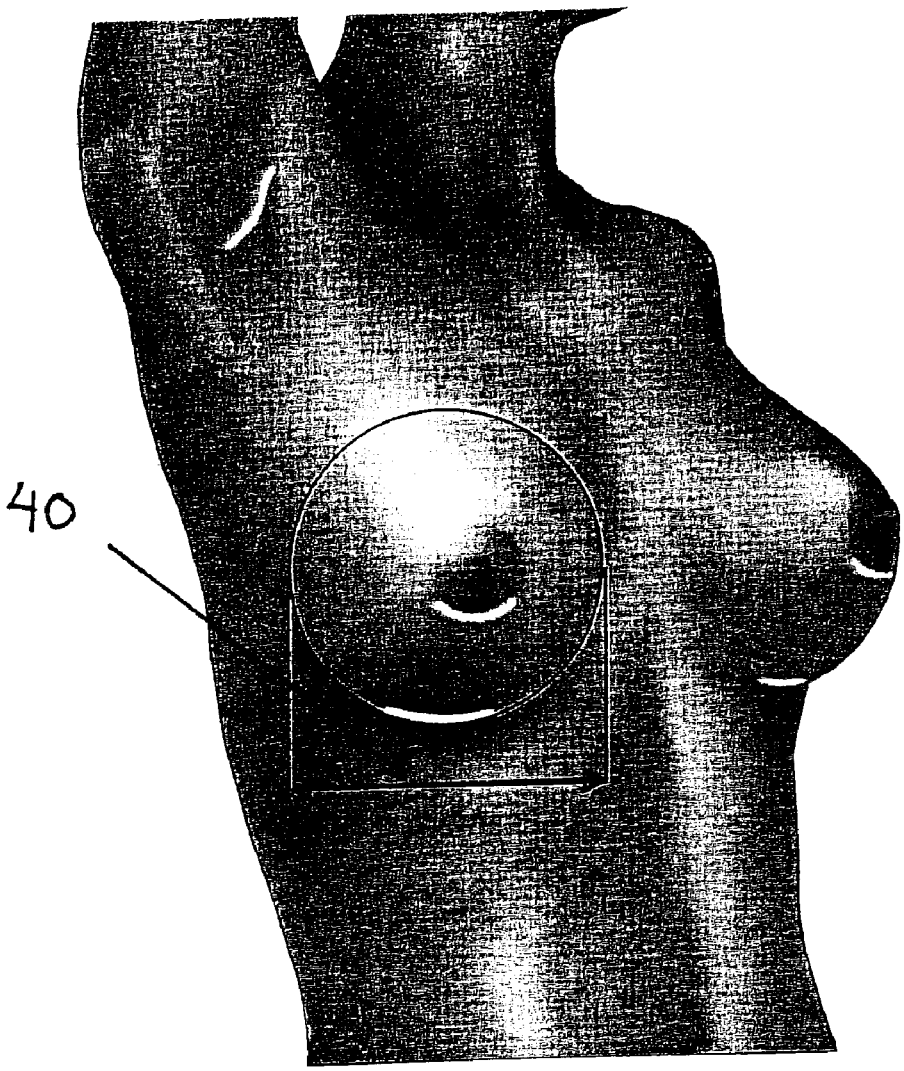
FIG. 4 is a schematic illustration of a woman with augmented breasts showing the base diameter of an augmented breast.

Each underwire 26 of FIG. 3 preferably matches the circular shape of an augmented breast as essentially provided by the "round" implant. Therefore, the base diameter of the augmented breast can provide the diameter of the semicircular portion 34 that will encircle the lower part of the breast base and help support the breast within the brassiere cup. As shown in FIG. 4, the breast base diameter is illustrated, and may be measured with a caliper or through other known means. Though the woman preferably stands with her arms at her side during measurement, FIG. 4 illustrates an uplifted arm for clarity. A base diameter 40 is measured at the level of the nipple along a horizontal line as illustrated. This measurement provides the diameter of the semicircular underwire necessary for the particular woman being measured.

As illustrated in FIG. 2, there should be no space between the center front connector 30 and the chest wall, i.e., it should lie on the chest wall, in a properly fitted, comfortable and attractive brassiere that offers the full benefit of a cantilevered support system. The center front connector 30 of the current invention ensures proper fit, comfort and support for the breasts. Accordingly, and as illustrated in FIG. 3, the center front connector is preferably constructed so that a connector distance 42 is established between the adjacent center extensions 36 of the underwires 26. The connector distance 42 is approximately 2.5 cm (centimeters) in a preferred embodiment of the invention which may suit the dimensions of many women with augmented breast.

This distance may remain constant for all underwire and cup sizes. However, in light of the fact that there are many woman of various upper torso dimensions, the connector distance 42, in other embodiments of the invention, may be varied to be lesser or greater than 2.5 cm. The connector distance thus may be chosen to suit the comfort or desire or the wearer, and in some embodiments of the invention may be varied through the use of an adjustable connector. The base diameter of an augmented breast is relatively smaller than the base diameter of a natural breast of comparable volume. In a natural breast of equal volume, the breast tissue is less centrally located, less confined and softer, and extends more toward center front as well as laterally thus narrowing and enhancing the cleavage or space between the breasts at center front. In an augmented breast, the saline or silicone-gel inside the silicone shell of the implant is confined and is located more centrally behind the nipple thus creating a wider cleavage which is often an indicator of a breast augmentation. In a properly fitted, attractive brassiere, the center front section rests comfortably on the chest wall and is an integral part of the brassiere's cantilevered support system.

The center front deflection of the underwires helps to camouflage and visually minimize the center front connector distance 42 of FIG. 3. The cleavage appears less wide as well. The actual inter-breast distance granted by this design is greater than the connector distance 42 but appears less due to the center extensions of the underwires. This enhances the appearance of the brassiere as well as the cosmetic result of the breast augmentation without sacrificing comfort, fit, support or beauty of the brassiere.

The center front connector of the brassiere may be made with either a low cut or a V-cut and of non-stretch fabric to accentuate the cleavage. It is anticipated that the brassiere will be made available in a wide variety of styles and colors. A full cup brassiere can also be made available, if so desired. The brassiere may be made with lace or embroidering, or may be formed as a seamless brassiere with either a soft cup or a molded cup. A racerback design can also be made in accordance with the design of the underwires and cup, as discussed above. Strapless and convertible versions of the brassiere are also anticipated, based on the construction discussed above. It is anticipated that the brassiere will come in sizes 32–40 B, C, D and DD, respectively, sized in accordance with United States and International standards.

The construction of cups 18 of the brassiere 16 of this invention mimics the generally hemispherical shape of the augmented breast as illustrated in FIG. 2, with a convex downslope 20 extending from below the clavicle 22 to the nipple 24. The spherical shape of the brassiere cup 18 thus provides a proper fit for the superior pole fullness and anterior nipple-areolar projection (bust point) of an augmented breast.

Brassiere manufacturers typically construct a series of patterns, called design slopers, which represent the range of breast shapes and sizes of the female population. The slopers are used to produce two dimensional fabric patterns to be assembled into brassieres shaped in three dimensions. In some cases, seamless brassiere cups are produced by stretching fabric over a heated sloper, called a mandrel. Each manufacturer may have its own, highly guarded and coveted series of slopers. For the brassiere of this invention, it is anticipated that design slopers will be drafted from women of average height and body weight with breast band sizes ranging from 32 to 40 inches and with augmented breast cup sizes ranging from a B cup to a DD cup size. For design purposes, the pre-augmentation breast size of these women ideally should not be larger than a B cup so that the post-augmented breast most closely mimics the shape and volume of the underlying breast implant.

Figure 5:
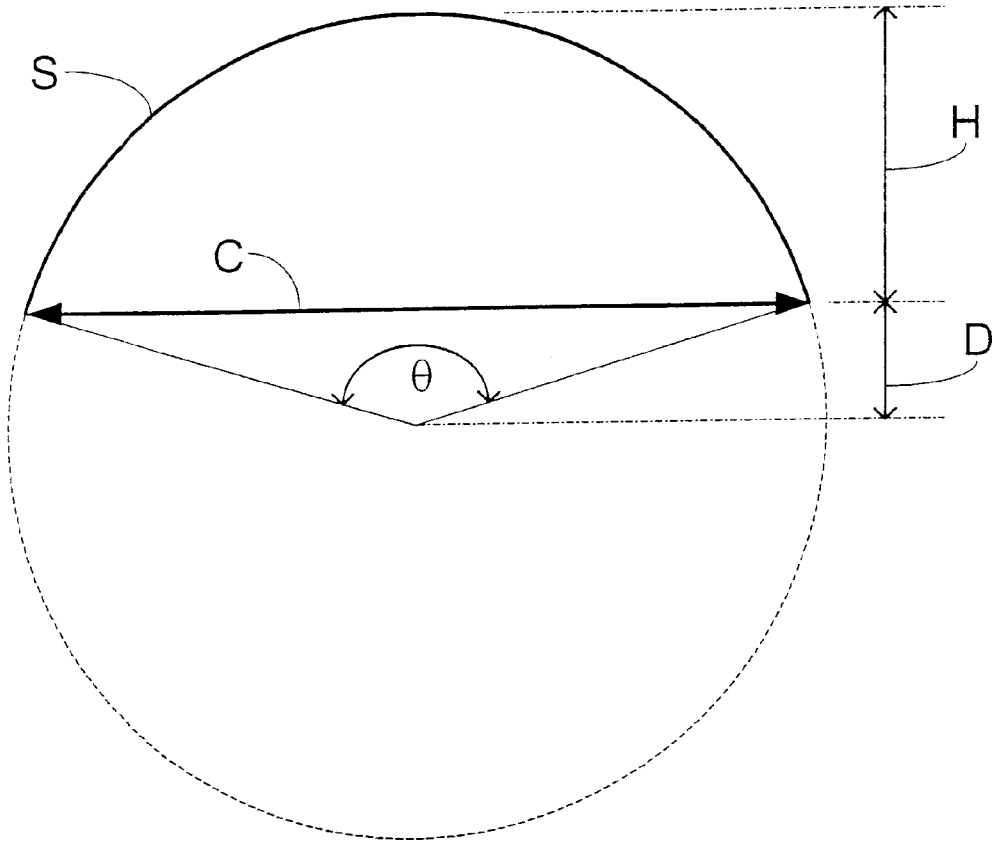
FIG. 5 is a geometric illustration of a partial sphere for use in sloper design according to an embodiment of the present invention.
Figure 6:
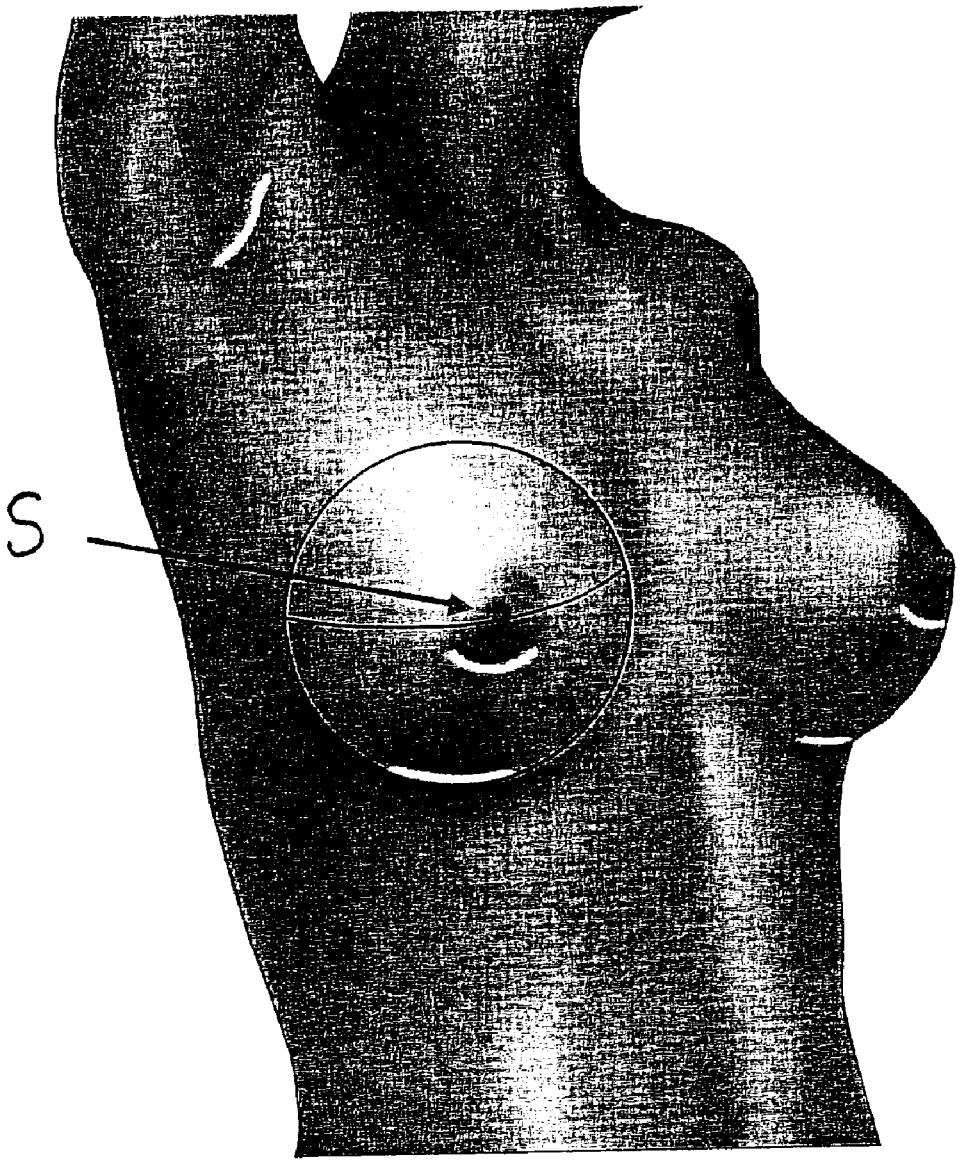
FIG. 6 is a schematic illustration of a woman with augmented breasts showing the arc of an augmented breast.

A design sloper useful in the production of a brassiere cup 18 (FIG. 2) according to the present invention will provide for a bust shaped upon a chest wall as a pair of partial spheres. A partial sphere can be defined by the length of a chord C and the length of the subtended circular arc S as illustrated in FIG. 5. The circular arc S represents the cross section of the bust sphere at its maximum projection from the chest wall. The length of the arc S can be measured as illustrated in FIG. 6 directly from the woman to be fitted with a brassiere or the woman from which the sloper is to be drafted. The length of the chord C is the breast base diameter 40 measured as discussed above with reference to FIG. 4.

Referring to FIG. 6, the length of the arc S of the breast is measured horizontally with a flexible tape vertically positioned at the level of the nipples in the standing position with the arms at the side. The tape should extend from the chest wall between the breasts, conform to the shape of the breast, and reach the chest wall lateral to the breast. The tape should be snug but not compressive or distorting. Though the woman preferably stands with her arms at her side during measurement, FIG. 6 illustrates an uplifted arm for clarity.

The construction parameters of partial spheres representing augmented breasts for a design sloper can be determined from the measured lengths of the circular arc S and the chord C. For example, the angle è (theta), measured in radians, subtended by the circular arc S can be calculated from the equation:

$$C/_S = \sin(X)/_X$$

where X is half of the angle subtended by the circular arc (X=è/2) defined for convenience in the solution of the equation.

The above equation can be solved for theta by known methods, for example those methods employed by mathematicians. In particular, theta can be determined using an iterative numerical calculation technique called Newton's Method. Other parameters of the partial sphere can be subsequently determined as desired or required in the construction of a partial sphere using the following example equations:

$$R = S/_{è\times}$$

$$D = R\cos(2è)$$

$$H = R - D$$

where R is the radius of the circular arc, D is the apothem as defined according to FIG. 5, and H is the height of the partial sphere above the chord. Other equations for the determination of other parameters of the partial sphere may be known and applied by mathematicians.

A proper design sloper for a woman with augmented breasts can thus be constructed adhering to the relationships among the parameters of the above equations. Such a design sloper may then be used in the construction of a brassiere in keeping with a preferred embodiment of the invention, which is a brassiere comprising breast support cups shaped as partial spheres to mimic the shape of, and thus correctly support, a woman's augmented breasts. It is anticipated that a manufacturer of brassieres may construct a series of such design slopers within useful ranges of brassiere band and support cup sizes, as described above. Alternately, a custom-fit brassiere for any particular woman may be constructed using the methods described herein.

The novel features of this invention may be applied to only one support cup and underwire of a brassiere having two separate support cups and underwires to provide optimal comfort and fit to a woman with a single augmented breast, for example a breast cancer patient having received a unilateral mastectomy and subsequent breast augmentation reconstruction.

Although preferred embodiments of the invention has been disclosed in the foregoing specification, it is understood by those skilled in the art to which the invention pertains that many modifications and other embodiments of the invention will come to mind, having the benefit of the teaching present in the foregoing description. Accordingly, it is understood that the invention is not limited to specific embodiments disclosed herein, and that many modifications and other embodiments of the invention are intended to be included in the scope hereof. Moreover, although specific terms are employed herein, they are used in the generic and descriptive sense only, and are not intended to limit the scope of the invention.

What is claimed is:

1. A brassiere for a person with at least one breast implant forming an augmented breast, the breast implant having a horizontal axis bisecting an implant center of the implant, said brassiere comprising:

at least one support cup constructed and arranged for complementary fit with at least a portion of one augmented breast, the support cup having a cup axis that is parallel to the horizontal axis of the implant and defining a central point on the cup axis; and an elongate underwire formed as a part of the at least one support cup, the underwire defining arcuate portion that is positioned below the cup axis of the support cup, the arcuate portion forming a circular arc spaced a first radial distance from the central point, wherein the arcuate portion subtends an angle through approximately 140 degrees between a first end and a second end.

2. The brassiere of claim 1, the underwire further comprising a lateral elongate extension extending away from and outwardly of the second end of the arcuate portion of the underwire, wherein a distal end of the lateral extension extends above the cup axis, and wherein the distal end of the lateral extension is spaced a third radial distance from the central point, the third radial distance being greater than the first radial distance.

3. The brassiere of claim 2, wherein the distal end of the lateral elongate extension is positioned about 10 degrees above the cup axis.

4. The brassiere of claim 2, wherein at least a portion of the center extension extends tangentially with respect to the circular arc of the arcuate portion, and wherein at least a portion of the lateral extension extends tangentially with respect to the circular arc of the semicircular portion.

5. The brassiere of claim 1, wherein the at least one support cup includes a first support cup and a second support cup, and wherein the underwires formed within each of the respective first support cup and second support cup are spaced from and with respect to each other.

6. The brassiere of claim 5, further comprising a connector attaching the first support cup to the second support cup.

7. The brassiere of claim 6, wherein the connector is constructed and arranged to space the proximal ends of the center extensions of the underwires formed within each of the respective first and second cups a distance of approximately 2.5 cm from one another.

8. The brassiere of claim 6, wherein the brassiere is adapted to position and hold at least a portion of the connector against the chest wall of the wearer.

9. The brassiere of claim 1, wherein the cup axis is substantially co-axial to the horizontal axis of the implant.

10. The brassiere of claim 1, wherein the underwire further comprises a center extension extending away from and outwardly of the first end of the arcuate portion of the underwire, wherein a proximal end of the center extension is spaced a second radial distance from the central point, the second radial distance being greater than the first radial distance.

11. The brassiere of claim 1, wherein the arcuate portion subtends the angle through about 140 degrees between the first end and the second end.

12. The brassiere of claim 1, wherein the first end of the arcuate portion of the underwire is positioned about 20 degrees below the cup axis.

13. The brassiere of claim 1, wherein a portion of the support cup has a spherical cap shape.

14. The brassiere of claim 13, wherein the portion of the support cup having the spherical cap shape extends substantially about the central point of the support cup.

15. A brassiere for a person with at least one breast implant forming an augmented breast, the breast implant having a horizontal axis bisecting an implant center of the implant, said brassiere comprising:

at least one support cup constructed and arranged for complementary fit with at least a portion of one augmented breast, the support cup having a cup axis that is parallel to the horizontal axis of the implant and defining a central point positioned on the cup axis; and an elongate underwire formed as a part of the at least one support cup, the underwire defining arcuate portion that is positioned below the cup axis of the support cup, the arcuate portion forming a circular arc spaced a first radial distance from the central point, wherein a portion of the support cup has a spherical cap shape.

16. The brassiere of claim 15, wherein the arcuate portion subtends an angle through about 140 degrees between a first end and a second end.

17. The brassiere of claim 16, wherein the underwire further comprises a center extension extending away from and outwardly of the first end of the arcuate portion of the underwire, wherein a proximal end of the center extension is spaced a second radial distance from the central point, the second radial distance being greater than the first radial distance.

18. The brassiere of claim 17, the underwire further comprising a lateral elongate extension extending away from and outwardly of the second end of the arcuate portion of the underwire, wherein a distal end of the lateral extension extends above the cup axis, and wherein the distal end of the lateral extension is spaced a third radial distance from the central point, the third radial distance being greater than the first radial distance.

19. The brassiere of claim 18, wherein the distal end of the lateral elongate extension is positioned about 10 degrees above the cup axis.

20. The brassiere of claim 18, wherein at least of the center extension extends tangentially with respect to the circular arc of the arcuate portion, and wherein at least a portion of the lateral extension extends tangentially with respect to the circular arc of the arcuate portion.

21. The brassiere of claim 16, wherein the arcuate portion subtends the angle through about 140 degrees between the first end and the second end.

22. The brassiere of claim 16, wherein the respective first end and second end of the arcuate portion of the underwire are each positioned about 20 degrees below the cup axis.

23. The brassiere of claim 15, wherein the at least one support cup includes a first support cup and a second support cup, wherein the underwires formed within each of the respective first support cup and second support cup are spaced from and with respect to each other, further comprising a connector connected to and extending between the first support cup and the second support cup.

24. The brassiere of claim 23, wherein the connector extending between the first support cup and the second support cup is constructed and arranged to space the proximal ends of the center extensions of the underwires formed within the respective first and second cups a distance of about 2.5 cm from one another.

25. The brassiere of claim 15, wherein the cup axis is substantially co-axial to the horizontal axis of the implant.

26. The brassiere of claim 15, wherein the portion of the support cup having the spherical cap shape extends substantially about the central point of the support cup.

27. A method of forming a brassiere for a person with at least one breast implant forming an augmented breast, the breast implant having a horizontal axis bisecting a center of the implant, the method comprising:

a. measuring a circular arc of the augmented breast at its maximum projection from the chest wall;

b. measuring a base diameter of the augmented breast;

c. determining a desired size of a spherical cap based on the measured circular arc and base diameter of the augmented breast;

d. forming a first support cup and a second spaced support cup, each support cup constructed and arranged for complementary fit with at least a portion of one augmented breast, the support cup having a cup axis that is co-axial to the horizontal axis of the implant, a portion of the support cup having a spherical cap shape that is the determined size.

28. The brassiere of claim 27, wherein the spherical cap shape extends substantially about the central point of the support cup.

29. The method of claim 27, further comprising forming an elongate underwire as a part of the each support cup, the underwire defining a arcuate portion that is positioned below the cup axis of the support cup, the arcuate portion forming a circular arc spaced from the central point a first radial distance determined from the measured base diameter of the breast.

30. The brassiere of claim 29, wherein the arcuate portion subtends an angle through about 140 between a first end and a second end.

31. The method of claim 30, wherein the arcuate portion subtends the angle through about 140 degrees between the first end and the second end.

32. The brassiere of claim 30, wherein the underwire further comprises a center extension extending away from and outwardly of the first end of the arcuate portion of the underwire, wherein a proximal end of the center extension is spaced a second radial distance from the central point, the second radial distance being greater than the first radial distance.

33. The brassiere of claim 32, the underwire further comprising a lateral elongate extension extending away from and outwardly of the second end of the arcuate portion of the underwire, wherein a distal end of the lateral extension extends above the cup axis, and wherein the distal end of the lateral extension is spaced a third radial distance from the central point, the third radial distance being greater than the first radial distance.

34. The brassiere of claim 33, wherein the distal end of the lateral elongate extension is positioned about 10 degrees above the cup axis.

35. The brassiere of claim 32, further comprising forming a connector attaching the first support cup to the second support cup that the proximal ends of the center extensions of the underwires formed within the respective first and second cups a distance of about 2.5 cm from one another.

* * * * *